US012590535B1

(12) United States Patent
Chatellard et al.

(10) Patent No.: US 12,590,535 B1
(45) Date of Patent: Mar. 31, 2026

(54) WELLBORE COMMUNICATION SYSTEM

(71) Applicant: Schlumberger Technology Corporation, Sugar Land, TX (US)

(72) Inventors: Julien Chatellard, Clamart (FR); Bertrand Mancelle, Clamart (FR); Tianhua Zhang, Clamart (FR); Vladimir Shitikov, Clamart (FR); Nicolas Guillon, Clamart (FR); Ghislain Bovin, Clamart (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/073,066

(22) Filed: Mar. 7, 2025

(51) Int. Cl.
*E21B 47/12* (2012.01)
*E21B 17/00* (2006.01)
*E21B 47/06* (2012.01)

(52) U.S. Cl.
CPC ..... *E21B 47/12* (2013.01); *E21B 17/003* (2013.01); *E21B 47/06* (2013.01)

(58) Field of Classification Search
CPC ..... E21B 47/06; E21B 47/12; E21B 47/125; E21B 47/26; E21B 17/003
See application file for complete search history.

(56) References Cited

U.S. PATENT DOCUMENTS 2,354,887 A 8/1944 Silverman
2,364,957 A 12/1944 Norvel
3,381,138 A 4/1968 Shintaro
3,967,201 A 6/1976 Rorden
4,496,203 A 1/1985 Meadows
4,578,675 A 3/1986 Macleod
4,691,203 A 9/1987 Rubin
5,331,331 A 7/1994 Wu
7,605,716 B2 10/2009 Peter
8,711,045 B2 * 4/2014 Contant ..... H01Q 1/04 343/719
8,749,400 B2 6/2014 Robbins
8,773,278 B2 * 7/2014 Contant ..... E21B 47/13 340/854.3
9,359,888 B2 6/2016 Lemenager
9,459,371 B1 10/2016 Holmen
9,482,085 B2 11/2016 Petrovic
9,765,613 B2 9/2017 Cramer
10,100,634 B2 10/2018 Ganguly
10,113,419 B2 10/2018 Wilson
(Continued)

*Primary Examiner* — Franklin D Balseca
(74) *Attorney, Agent, or Firm* — Jeffrey D. Frantz

(57) ABSTRACT

A wellbore communication system includes a first conduction component secured to the electrically conductive axial support body and electrically connected to the electrically conductive axial support body. The first conduction component is electrically conductive. A transmitter positioned a first distance from the first conduction component on the electrically conductive axial support body and is electrically connected to the electrically conductive axial support body. A second conduction component is disposed on the electrically conductive axial support body a second distance from the first conduction component such that the second distance is greater than the first distance. The second conduction component is electrically conductive and is electrically insulated from the electrically conductive axial support body. A cable is electrically connected to the transmitter and the second conduction component.

20 Claims, 5 Drawing Sheets

(56) References Cited

U.S. PATENT DOCUMENTS

| | | | | |
|---|---|---|---|---|
| 10,119,393 | B2 | 11/2018 | Derkacz | |
| 10,323,510 | B2 | 6/2019 | DePavia | |
| 10,378,337 | B2 | 8/2019 | DePavia | |
| 10,598,809 | B2 | 3/2020 | Chung | |
| 10,704,385 | B2 | 7/2020 | Chen | |
| 10,961,843 | B2 | 3/2021 | Logan | |
| 11,073,013 | B2 | 7/2021 | Homan | |
| 11,411,298 | B2 * | 8/2022 | White | E21B 47/13 |
| 11,643,925 | B2 | 5/2023 | Ross | |
| 11,852,009 | B2 | 12/2023 | Ross | |
| 12,071,847 | B2 | 8/2024 | Cooley | |
| 2015/0285062 | A1 | 10/2015 | Logan | |
| 2015/0315906 | A1 | 11/2015 | Rodney | |
| 2021/0404326 | A1 | 12/2021 | Wilson | |
| 2022/0145754 | A1 | 5/2022 | Trinder | |

* cited by examiner

WELLBORE COMMUNICATION SYSTEM

BACKGROUND OF THE DISCLOSURE

The desire to obtain information from a wellbore continues during production of the well and even after abandonment. However, the ability to send information to the surface is impeded by the formations through which the wellbore extends and the depths from which the information is collected. In particular, electromagnetic signals do not propagate efficiently through geologic formations.

Related patents include U.S. Pat. No. 11,073,013 is directed to an electric dipole surface antenna configurations for electromagnetic wellbore instrument telemetry. U.S. Pat. No. 8,773,278 is directed to an apparatus for receiving and transmitting signals in electromagnetic telemetry system used in a wellbore. U.S. Pat. No. 9,459,371 is directed to a retrievable downhole cable antenna for an electromagnetic system.

SUMMARY

In some embodiments, a wellbore communication system includes a first conduction component configured to be secured to an electrically conductive axial support body and electrically connected to the electrically conductive axial support body. The first conduction component is electrically conductive. A transmitter is configured to be positioned a first distance from the first conduction component on the electrically conductive axial support body. The transmitter is configured to be electrically connected to the electrically conductive axial support body. The transmitter may include a first electrode connected to the electrically conductive axial support body and a second electrode. A second conduction component is configured to be disposed on the electrically conductive axial support body a second distance from the first conduction component. The second conduction component is electrically conductive. The second distance is greater than the first distance. The second conduction component is configured to be electrically insulated from the electrically conductive axial support body. A cable is configured to be electrically connected to a second electrode of the transmitter and the second conduction component. The cable includes an electrical conductor, such that when secured to the electrically conductive axial support body, the electrical conductor is not in contact with the electrically conductive axial support body or with fluid that may be surrounding the wellbore communication system.

In some embodiments, a wellbore communication system includes an electrically conductive axial support body, a first conduction component secured to the electrically conductive axial support body and electrically connected to the electrically conductive axial support body. The first conduction component is electrically conductive. A transmitter is positioned a first distance from the first conduction component on the electrically conductive axial support body and is electrically connected to the electrically conductive axial support body. The transmitter may include a first electrode connected to the electrically conductive axial support body and a second electrode. A second conduction component disposed on the electrically conductive axial support body a second distance from the first conduction component. The second distance being greater than the first distance. The second conduction component is electrically conductive and is electrically insulated from the electrically conductive axial support body. A cable is electrically connected to the second electrode of the transmitter and the second conduction component. The cable includes an electrical conductor, but the electrical conductor is not in contact with the electrically conductive axial support body or with fluid that may be surrounding the wellbore communication system.

In some embodiments, a method includes securing a first conduction component to an electrically conductive axial support body. The first conduction component is electrically conductive and is electrically connected to the electrically conductive axial support body. The method includes securing a first electrode of a transmitter positioned a first distance from the first conduction component on the electrically conductive axial support body. The method also includes securing a second conduction component on the electrically conductive axial support body a second distance from the first conduction component. The second distance being greater than the first distance. The second conduction component is electrically conductive and is electrically insulated from the electrically conductive axial support body. The method includes electrically connecting a cable to a second electrode of the transmitter and the second conduction component. The cable includes an electrical conductor, but the electrical conductor is not in contact with the electrically conductive axial support body or with fluid that may be surrounding the wellbore communication system.

In some embodiments, a method includes securing a conduction component to an electrically conductive axial support body. The first conduction component is electrically conductive and is electrically connected to the electrically conductive axial support body. The method includes securing a first electrode of a transmitter positioned a first distance from the first conduction component on the electrically conductive axial support body. The method also includes securing a second conduction component on the electrically conductive axial support body a second distance from the first conduction component. The second distance being greater than the first distance. The second conduction component is electrically conductive and is electrically connected to the electrically conductive axial support body. The method includes electrically connecting a cable to a second electrode of the transmitter and the second conduction component. The cable includes an electrical conductor, but the electrical conductor is not in contact with the electrically conductive axial support body or with fluid that may be surrounding the wellbore communication system.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which.

DETAILED DESCRIPTION

Figure 1:
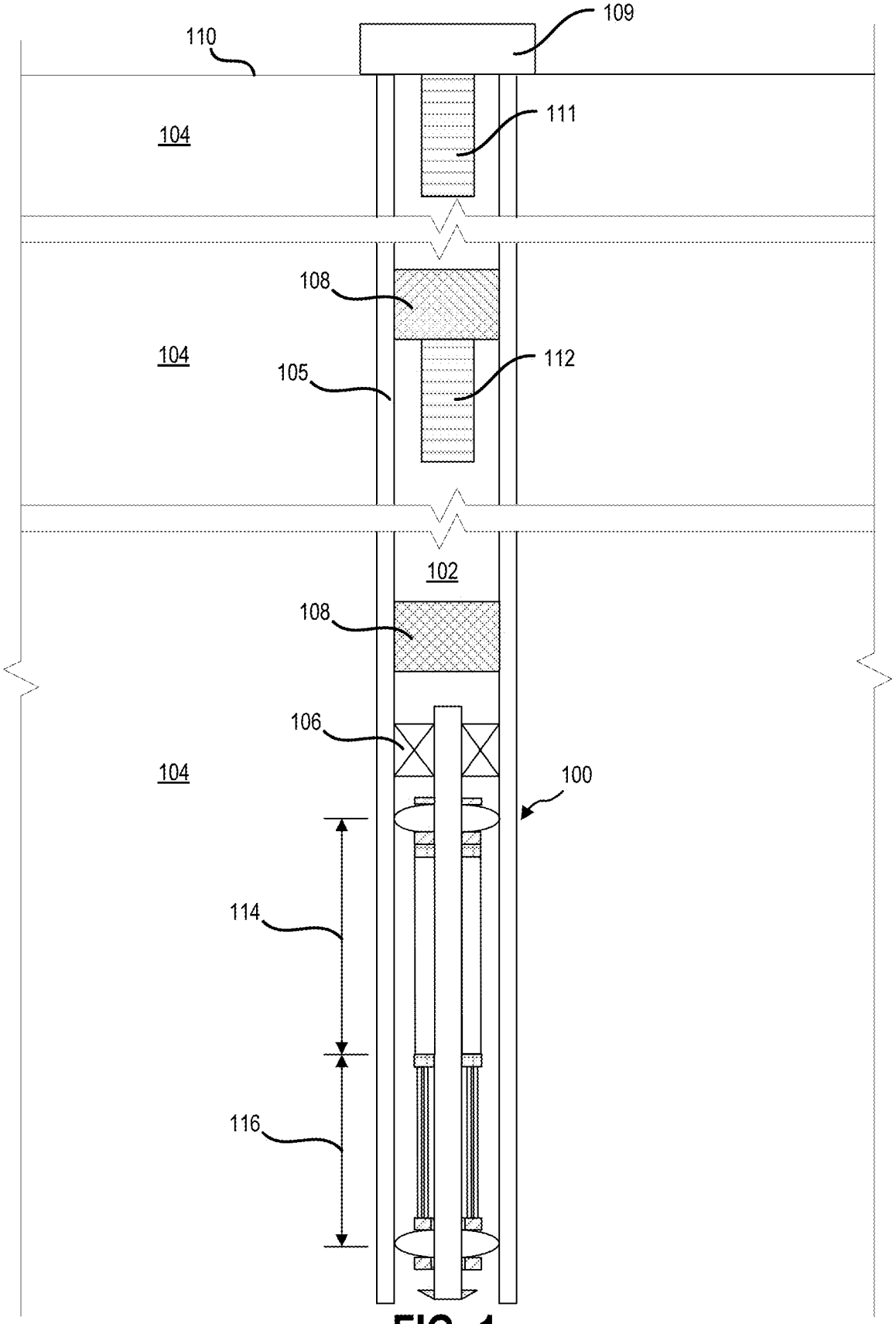
FIG. 1 is a side view of a schematic diagram of a wellbore with a wellbore communication system according to at least one embodiment of the present disclosure.

This disclosure generally relates to devices, systems, and methods for a wellbore communication system. The wellbore communication system improves the range and signal to noise ratio of well bore communications, especially in deep communication applications. Consequently, fewer repeater stations may be needed in applications where the claimed wellbore communication system is used, which reduces the costs of monitoring a wellbore.

The wellbore communication system includes a first conduction component configured to be secured to an electrically conductive axial support body and electrically connected to the electrically conductive axial support body. A conduction component is any structure or element, such as a centralizer, that electrically connects the wellbore communication system with the well casing. The first conduction component is electrically conductive.

The wellbore communication system further includes a transmitter configured to be positioned a first distance from the first conduction component on the electrically conductive axial support body. The transmitter includes a first electrode that is configured to be electrically connected to the electrically conductive axial support body. The wellbore communication system may include a specially designed coaxial bulkhead connected to the transmitter and may be used to attach the transmitter to the electrically conductive axial support body. The coaxial bulkhead inner layer, cable, and transmitter may constitute a second electrode, which may also be referred to as a hot or transmitting electrode. The coaxial bulkhead outer layer may be connected to the electrically conductive axial support body and a first electrode, which may be referred to as a cold or receiving electrode, that may be connected to the electrically conductive axial support body. In other words, the coaxial bulkhead may be considered an extension of the transmitter. A hot electrode, or injection pole, is used to inject current into the formation through the cable and the second centralizer. A cold electrode, or return pole, is used to receive the return current from the formation.

The transmitter may be a transceiver and include a receiver. The wellbore communication system may be connected to a power source or include a battery sized to support the communication needs of the wellbore communication system for a desired period of time. The wellbore communication system may also include a processor, a memory, and a sensor. A variety of sensors may be included to monitor various aspects of the wellbore position in which the wellbore communication system has been installed. For example, the sensor may be a pressure sensor, an inclinometer, a strain gauge, a temperature sensor, a flow sensor, a seismic sensor, a resistivity/dielectric sensor, or any other sensor used in wellbore monitoring.

A second conduction component is configured to be disposed on the electrically conductive axial support body a second distance from the first conduction component. The second distance is greater than the first distance. The second conduction component is electrically conductive, but is configured to be electrically insulated from the electrically conductive axial support body. For example, the second conduction component may include a mounting surface that includes a diameter that is greater than a similar mounting surface on the first conduction component in order to accommodate an electric insulator being disposed between the electrically conductive axial support body and the second conduction component. When installed on the electrically conductive axial support body in a wellbore, the second conduction component is placed beneath the first conduction component.

Further, a cable is configured to be electrically connected to the transmitter and the second conduction component. The cable includes an electrical conductor such that when secured to the electrically conductive axial support body, the electrical conductor is not in contact with the electrically conductive axial support body. In other words, the cable is electrically isolated from the electrically conductive axial support body and from fluid that may be encountered when in use in a wellbore. The cable allows the transmission of electromagnetic waves at one or more frequencies. The length of the cable may be tuned by cutting a desired length of the cable and adjusting the position of the second conduction component accordingly.

The wellbore communication system operates by collecting data from its sensors. The sensors pass signals to the processor and the processor may save the data from the signals in the memory. When it is time to transmit the saved data, the processor accesses the saved data and converts the data into a signal in the form of a modulated voltage and current. The transmitter passes the modulated voltage and current from the transmitter through the cable, into the second conduction component, and into a well casing of the wellbore that the wellbore communication system is positioned in. The current flows through the well casing toward the first conduction component. At the first conduction component, the current flows through the conduction component and the electrically conductive axial support body back to the transmitter. This flow of current creates an electromagnetic signal that travels through the well casing and the surrounding formations to another wellbore communication system or repeater disposed a distance away in the wellbore, until the signal is passed to a transceiver on the surface. In some embodiments, a wellbore communication system includes a first conduction component configured to be secured to an electrically conductive axial support body and electrically connected to the electrically conductive axial support body. The first conduction component is electrically conductive. A transmitter is configured to be positioned a first distance from the first conduction component on the electrically conductive axial support body. The transmitter is configured to be electrically connected to the electrically conductive axial support body. The transmitter may include a coaxial bulkhead. The outer layer of the coaxial bulkhead is connected to the first electrode and connected to the electrically conductive axial support body. The inner layer of the coaxial bulkhead is connected to the second electrode. An electrical insulation material is disposed between the inner layer and the outer layer. A second conduction component is configured to be disposed on the electrically conductive axial support body a second distance from the first conduction component. The second conduction component is electrically conductive. The second distance is greater than the first distance. The second conduction component is configured to be electrically insulated from the electrically conductive axial support body. A cable is configured to be electrically connected to a second electrode of the transmitter and the second conduction component. The cable includes an electrical conductor, such that when secured to the electrically conductive axial support body, the electrical conductor is not in contact with the electrically conductive axial support body or with fluid that may be surrounding the wellbore communication system.

Alternatively in some embodiments, the wellbore communication system may receive a signal from the surface or a relay in the wellbore. The signal induces a current that passes from the first conduction component into the electrically conductive axial support body to the receiver. In other words, from the first conduction component, through the electrically conductive axial support body, to the transceiver is a receiver section of the wellbore communication system. Further, from the transceiver through the cable to the second conduction component is a transmission system.

By electrically isolating or insulating the electrically conductive axial support body from the cable and the second conduction component, higher intensity of current and voltage may be directed into the well casing and not lost in the electrically conductive axial support body, surrounding fluid, mud, and geologic formations. If more voltage and current is passed into the well casing, the signal will be stronger and should travel farther with enough strength to be received at the next relay or surface transceiver. Additionally, current and voltage from the transmission section is insulated from the electrically conductive axial support body to reduce or limit a portion of the modulated signal from passing into the electrically conductive axial support body, thereby reducing noise in the signals being received by the receiver section.

Further, the length of the cable determines the voltage drop created in the well casing surrounding the wellbore communication system. This voltage drop serves as a voltage source to excite electromagnetic waves in the formation. The larger the voltage drop in the casing, the higher the wave amplitude in the formation and the longer distance the excited electromagnetic waves can propagate.

FIG. 1 shows one example of a wellbore communication system 100 in a wellbore 102 drilled in a formations 104. As shown, a closed wellbore 102 is shown with a wellbore communication system 100 shown at the bottom of the wellbore in the formation 104. The wellbore 102 includes a well casing 105. The well casing 105 includes a steel pipe and a concrete or cement casing outside the casing pipe. The wellbore communication system 100 may be held in place by packers 106 or plugs 108. The wellbore communication system 100 may be used with wellbores that are in production or those that have been closed and had their drill string removed.

Plugs 108 may be placed in different locations in the wellbore 102 to isolate different sections of the wellbore 102. The plugs 108 may be made of concrete, cement, rubber, or composite, or may be a packer, or other structure.

Facilities 109 at the surface 110 may instruct a transceiver 111 at the surface 110 to send a signal down the wellbore 102. The signal is then received at the relay 112 where the signal is retransmitted. The signal is then received by a receiver section 114 of the wellbore communication system 100 and decoded by the wellbore communication system 100. The transceiver 111 and the relay 112 may be the same configuration as the wellbore communication system 100 or may be a different design of transceiver.

The wellbore communication system 100 may be connected to or include a sensor package (not shown). Data gathered at the bottom of the wellbore 102 by the sensors may then be transmitted by the wellbore communication system 100 as an electromagnetic signal generated by a transmission section 116. The signal travels to the relay 112, where the signal is retransmitted. Finally, the signal is received by the transceiver 111 at the surface 110 and delivered to the facilities 109.

In this embodiment, each communication segment is electromagnetic. However, in other embodiments, only the bottommost segment is electromagnetic to bypass the plug then communication in the upper part of the well may be acoustic along a drill string (with relays). In still other embodiments, the wellbore communication system at the bottom of an abandoned well communicates with another tool in a nearby active well which then communicates up the active well using either acoustic communication or electromagnetic communication.

Figure 2:
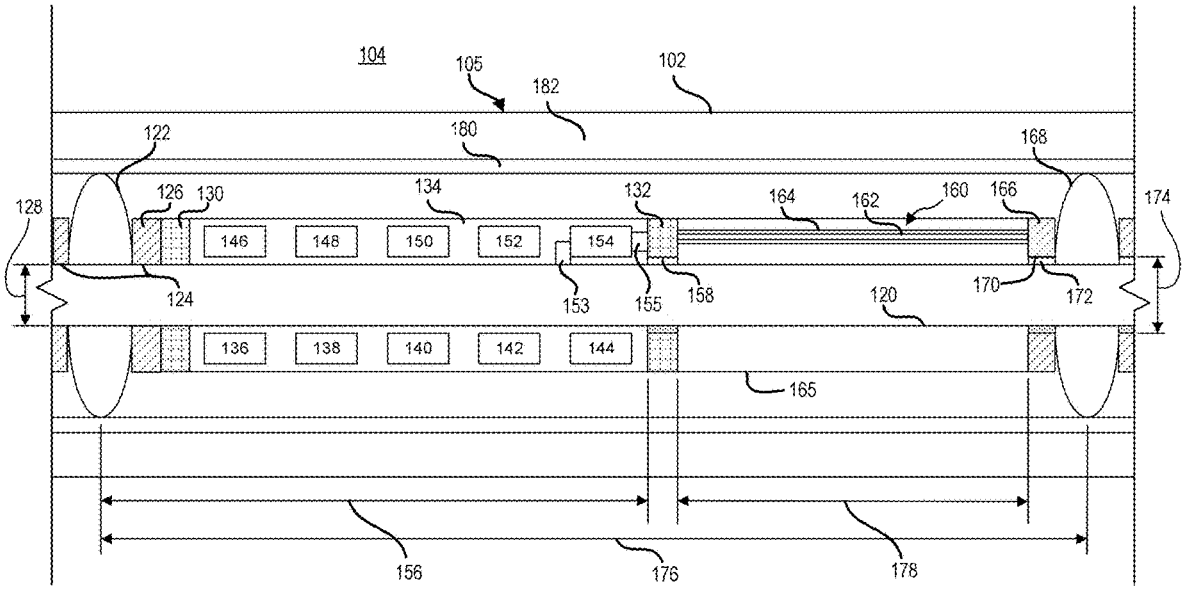
FIG. 2 is a side view of a schematic diagram of the wellbore communication system as shown in FIG. 1 according to at least one embodiment of the present disclosure.

FIG. 2 is a detailed schematic view of the wellbore communication system 100 disposed within the wellbore 102 shown in FIG. 1. As shown, the wellbore communication system 100 includes an electrically conductive axial support body 120 and a first conduction component 122 secured to the electrically conductive axial support body 120 by a mounting surface 124 of the mounting bracket 126. The electrically conductive axial support body 120 may be a tube, pipe, part of the drill string, or other structure. The mounting surface 124 includes a diameter 128. The first conduction component 122 is in electrical contact with the electrically conductive axial support body 120. In this embodiment, the conduction components may be a centralizer that has been configured to provide an electrical connection to the well casing.

A first bulkhead 130 and a second bulkhead 132 are used to secure an electronics package 134 to the electrically conductive axial support body 120. The first bulkhead 130 is secured to the electrically conductive axial support body 120 so that it is in electrical communication with the electrically conductive axial support body 120 and the first conduction component 122. The electronics package 134 may be in any shape or form. The electronics package 134 may be comprised of multiple individual cartridges or modules that may be installed in bulkheads attached to the electrically conductive axial support body 120.

The electronics package 134 may include a pressure sensor 136, a temperature sensor 138, a flow sensor 140, a seismic sensor 142, and other sensors 144. The electronics package 134 may also include a battery 146, a processor 148, a memory 150, a receiver 152, and a transmitter 154. The receiver 152 and transmitter 154 may be combined as a transceiver. The transmitter 154 includes a first electrode 153 and second electrode 155 that may be shared with the receiver 152.

The electronics package 134 may be organized in different configurations, such as discrete modules extending parallel to each other along the electrically conductive axial support body 120, as individual modules connected to a frame, or as annular sections around the electrically conductive axial support body 120 (not shown).

The processor 148 may be a general-purpose single or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor 148 may be referred to as a central processing unit (CPU). The processor 148 may be a single processor or a combination of processors (e.g., an ARM and DSP).

The memory 150 is in electronic communication with the processor 148. The memory 150 may be any electronic component capable of storing electronic information. For example, the memory 150 may be embodied as random access memory (RAM), read-only memory (ROM), magnetic disk storage media, optical storage media, flash memory devices in RAM, on-board memory included with the processor, erasable programmable read-only memory (EPROM), electrically erasable programmable read-only memory (EEPROM) memory, registers, and so forth, including combinations thereof.

Instructions and data may be stored in the memory 150. The instructions may be executable by the processor 148 to implement some or all of the functionality disclosed herein. Executing the instructions may involve the use of the data that is stored in the memory 150. Any of the various examples of modules and components described herein may be implemented, partially or wholly, as instructions stored in memory 150 and executed by the processor 148. Any of the various examples of data described herein may be among the data that is stored in memory 150 and used during execution of the instructions by the processor 148.

During operation, the pressure sensor 136, temperature sensor 138, flow sensor 140, seismic sensor 142, and other sensors 144 may provide data to the processor 148 for processing or storage in the memory 150. The memory 150 may include instructions that cause the processor 148 to process the data, received signals and transmit the data in a predetermined manner. Further, the first conduction component 122, electrically conductive axial support body 120, and first bulkhead 130 may be in electrical communication with the receiver 152 and act as the receiver section 114 (shown in FIG. 1) of a dipole antenna. In some configurations, the receiver 152 may be in direct electrical communication with the electrically conductive axial support body 120 and not in communication with the first bulkhead 130. The receiving section has a length 156 that extends from the first conduction component 122 to the receiver 152.

In some configurations, the receiver 152 may receive a signal that causes the processor 148 to instruct the transmitter 154 to transmit the data saved in memory 150. Alternatively, the processor 148 may instruct the transmitter 154 to transmit the data stored in the memory 150 according to a predetermined schedule.

The second bulkhead 132 of the wellbore communication system 100 includes electrical insulation 158 that electrically isolates the second bulkhead 132 from the electrically conductive axial support body 120 while allowing the second bulkhead 132 to be secured to the electrically conductive axial support body 120 and support the electronics package 134 and the sensors 136, 138, 140, 142, 144. Further, the second bulkhead 132 supports a cable 160 that is in electrical communication with the transmitter 154.

In this embodiment, the cable 160 includes an electrical conductor 162 covered by electrical insulation 164. As used in this application, the terms "electrical insulation" or "electrical isolation" include structures that provide electrical shielding and/or electrical insulation. The cable 160 may be flexible and may be wrapped around the electrically conductive axial support body 120 but electrically isolated from the electrically conductive axial support body so that the electrical conductor 162 does not contact the electrically conductive axial support body 120. A shield 165 may be placed around the cable 160 to protect the cable from snags and impacts while the wellbore communication system 100 is being placed and operating within the wellbore 102. The shield 165 may be made of plastic, metal, or a composite. The shield 165 may be secured to the second bulkhead 132 and the second conduction component 168 or wrapped around the cable 160 and the electrically conductive axial support body 120. The shield 165 may be electrically insulated from the second bulkhead 132, the cable conductor 162, mounting bracket 166 and second conduction component 168.

The cable 160 is electrically connected via the second bulkhead 132 to a second electrode of the transmitter 154. The cable 160 extends from the second bulkhead 132 to a mounting bracket 166 of a second conduction component 168 a distance 178. In some configurations, the cable 160 may be greater than 2.0 meters. In other configurations, the cable 160 may be greater than 3 meters. In other configurations, the cable 160 may be greater than 5 meters. In yet others, the cable 160 may be greater than 12 meters. In some embodiments, the cable 160 may have a length ranging between about 12 meters to about 25 meters, while in other, the length may be greater than 25 meters. Further, redundant cables may also be connected the second electrode of the transmitter 154 and to the second conduction component 168.

The mounting bracket 166 includes a mounting surface 170 that is electrically insulated 172 from the electrically conductive axial support body 120. The mounting surface 170 has a diameter 174 that allows the mounting bracket 166 to be secured to the electrically conductive axial support body 120 around the electrical insulation 172. The diameter 174 is greater than diameter 128. The electrical insulation 172 may be made of polytetrafluoroethylene, glass, and other electrically insulative and shielding materials. The electrical insulation 172 may be made of a fluoropolymer including one or more of a polytetrafluoroethylene, a fluorinated ethylene, a fluorinated propylene, or a perfluoroalkoxy alkane.

The second conduction component 168 is positioned a distance 176 from the first conduction component 122. The distance 176 is greater than the distance 156 that extends from the first conduction component 122 to the receiver 152. The transmission section 116 (shown in FIG. 1) extends from second electrode 155 of the transmitter 154 through the cable 160 and the second conduction component 168. A redundant cable (not shown) may also connect the second electrode 155 of the transmitter 154 to the second conduction component 168.

The first conduction component 122 and the second conduction component 168 protect the components of the wellbore communication system 100 from contacting the well casing 105. Specifically, The first conduction component 122 and the second conduction component 168 keep the wellbore communication system 100 positioned in the middle of the well casing 105 while the first conduction component 122 and the second conduction component 168 are in direct electrical contact with the well casing 105.

When transmitting, the transmitter 154 passes a voltage and current with one or more frequencies through the cable 160 and the second conduction component 168 into the well casing 105. The well casing 105 may include a steel liner or pipe 180 and a shell 182. The shell 182 may be made of concrete or cement. The current flows toward the first conduction component 122, the electrically conductive axial support body 120, and back toward the transmitter 154.

Figure 3:
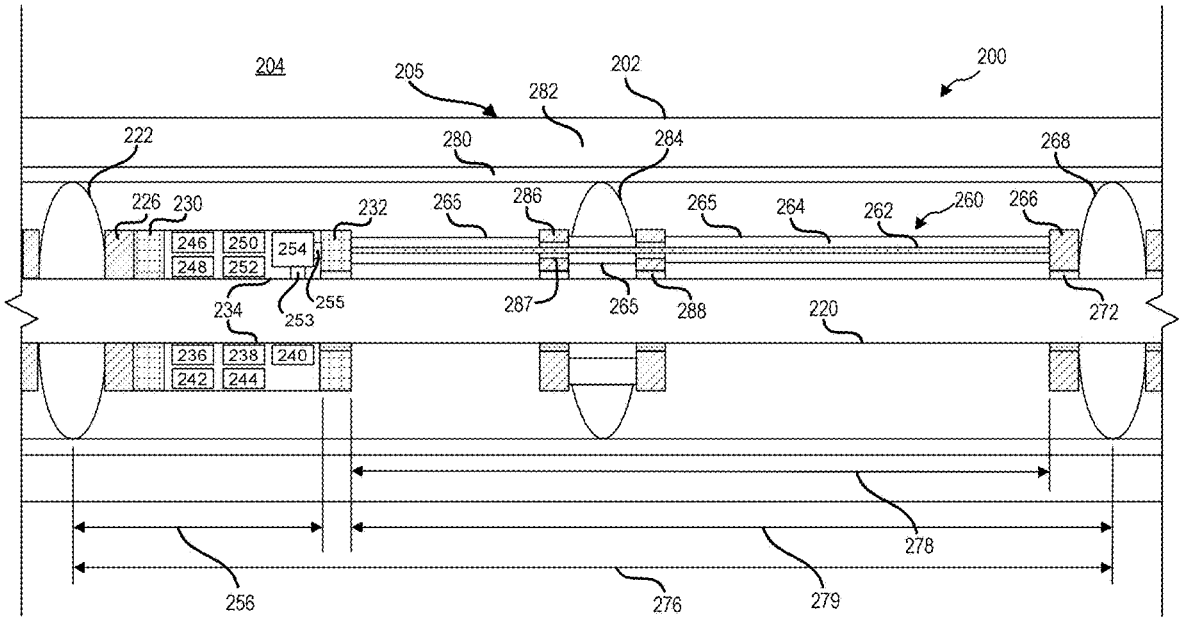
FIG. 3 is a side view of another schematic diagram of the wellbore communication system positioned within a wellbore, according to at least one embodiment of the present disclosure.

FIG. 3 is a side view of another schematic diagram of the wellbore communication system 200 positioned within a well casing 205 of a wellbore 202 in formation 204. The well casing 205 includes a steel tubing 280, for example a production tubing with the diameter larger than the wellbore communication system 200, and a casing 282. The casing 282 may be made of concrete, cement, or other suitable material.

The wellbore communication system 200 includes a first conduction component 222 secured to an electrically conductive axial support body 220 by a mounting bracket 226 and in electrical communication with the electrically conductive axial support body 220. A first bulkhead 230 is secured to the electrically conductive axial support body 220 adjacent the first conduction component 222. As shown, the first bulkhead 230 may be in electrical communication with the electrically conductive axial support body 220.

The first bulkhead 230 and the second bulkhead 232 support and secure the electronics package 234 to the electrically conductive axial support body 220. In some configurations, the first bulkhead 230 and the second bulkhead 232 may be designed to selectively electrically isolate different components of the electronics package 234 from the electrically conductive axial support body 220.

As shown, the electronics package 234 may include a pressure sensor 236, a temperature sensor 238, a flow sensor 240, a seismic sensor 242, and other sensors 244. The electronics package 234 may also include a battery 246, a processor 248, a memory 250, a receiver 252, and a transmitter 254. The receiver 252 and transmitter 254 may be combined as a transceiver. The transmitter 254 includes a first electrode 253 and second electrode 255 that may be shared with the receiver 252.

The wellbore communication system 200 includes a receiving section 256 that extends from the first conduction component in electrical communication through the electrically conductive axial support body 220 to the receiver 252. In some configurations, the receiver 252 may be in electrical connection with the electrically conductive axial support body 220 through the first bulkhead 230 or may be in direct electrical contact with the electrically conductive axial support body 220.

The second bulkhead 232 may be electrically isolated from the electrically conductive axial support body 220. The second bulkhead 232 supports the cable 260 and electrically connects the cable 260 to the transmitter 254.

The cable 260 includes an electrical conductor 262, an insulation gap 264, and a conduit 265. The electrical conductor 262 is disposed within, but not in contact with the conduit 265. The conduit 265 protects the electrical conductor 262 from the environment. The conduit 265 may be swaged with or otherwise connected to the second bulkhead 232, the second conduction component 268, and the third conduction component 284 to provide a strong metal-to-metal seal. Alternatively, the conduit 265 may be welded or brazed to the second bulkhead 232, the second conduction component 268, and the third conduction component 284. The insulation gap 264, may be air, electrical insulation, and/or electrical shielding.

As shown, the cable 260 is positioned to extend from the second bulkhead 232 to a mounting bracket 266 of the second conduction component 268. The cable 260 is electrically connected to the second conduction component 268. The second conduction component is electrically isolated from the electrically conductive axial support body 220 by an electrically insulative tape 272 made of polytetrafluoroethylene, glass, polycarbonate, or other non-conductive materials. The electrical insulative tape 272 may be made of a fluoropolymer including one or more of a polytetrafluoroethylene, a fluorinated ethylene, a fluorinated propylene, or a perfluoroalkoxy alkane.

A distance 276 from the first conduction component 222 to the second conduction component 268 is longer than the distance 256 from the first conduction component to the transmitter 254. The length 278 of the cable 260 may be greater than 12 meters. In terms of dipole antennas, the length 278 is the gap distance between the ends of a dipole antenna.

In some configurations, a third conduction component 284 may be positioned to support the cable 260. The third conduction component 284 includes mounting brackets 286 for securing the third conduction component to the electrically conductive axial support body 220. Optionally, the third conduction component 284 may be electrically isolated from the electrically conductive axial support body 220 by electrical insulation 288 disposed between the third conduction component 284 and the electrically conductive axial support body 220. In the illustrated configurations, the third conduction component 284 may include electrically insulated through holes 287 that support the electrical conductor 262. The conduit 265 may be swaged with the third conduction component 284 with additional sections of conduit 265 protecting portions of the electrical conductor 262 as it passes by the conduction component and between the third conduction component 284 and the second conduction component 268. Optionally one or more conduction component can be added in the system similarly to the third conduction component 284.

During use, isolation of the third conduction component 284 minimizes noise from the receiving section 256 from interfering with a transmission section 279 and vice versa. As discussed in reference to FIG. 2, the wellbore communication system 200 operates by receiving signals from a relay or transceiver (not shown) into the receiving section 256. The signal passes through the first conduction component 222, electrically conductive axial support body 220, and to the receiver 252. To transmit, the transmitter passes a current at a voltage through the cable 260 through the second conduction component into the well casing 205 generating an electromagnetic signal that is received by a relay or other transceiver. By insulating the receiving section from the transmission section, noise is reduced improving the signal to noise ratio.

Figure 3A:
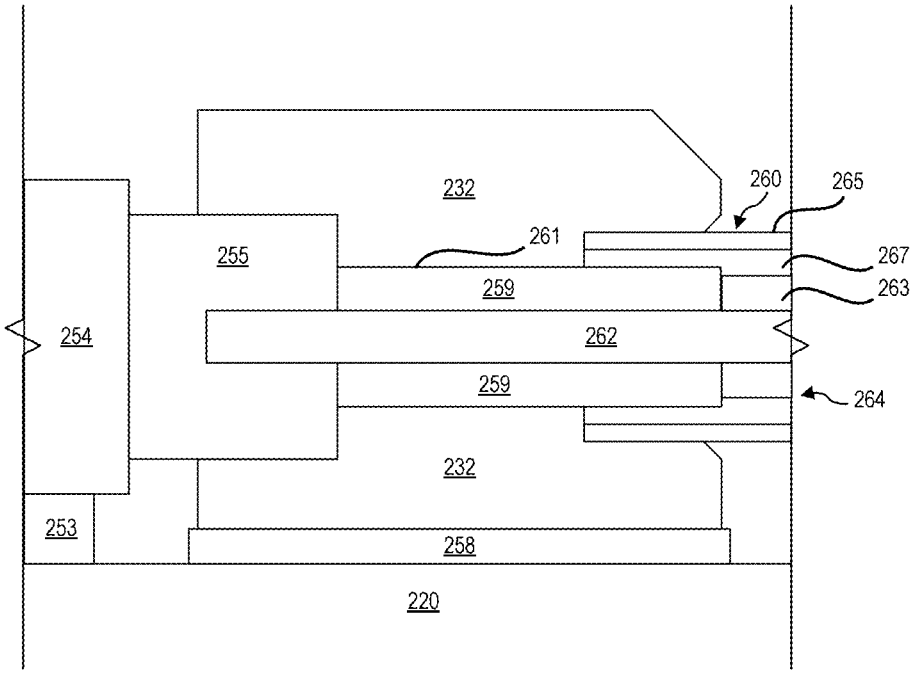
FIG. 3A is a side view of the second bulkhead of the wellbore communication system in FIG. 3.

FIG. 3A is a side view of the second bulkhead 232 of the wellbore communication system 200 in FIG. 3. As shown, the transmitter 254 includes the first electrode 253 and a second electrode 255. The second electrode 255 may be supported by and attached to the second bulkhead 232. The attachment between the second electrode 255 and the second bulkhead 232 may form a waterproof seal that prevents fluid from a wellbore from entering a passage 261 extending through the second bulkhead 232. The second bulkhead 232 may include electrical insulation 258 that may electrically isolate the second bulkhead 232 from the electrically conductive axial support body 220.

The cable 260 may include a connector 259 an electrical conductor 262, an insulation gap 264 including electrical insulation 263 and an air gap 267, and a conduit 265. The connector 259 of the cable 260 is attached to the bulkhead 232 and may provide a waterproof seal between the connector and the second bulkhead 232. The connector 259 may be made of electrically insulating glass or other electrically insulating material. The electrical conductor 262 of the cable extends and creates an electrical connection with the second electrode 255. In this embodiment, the connector 259 electrically insulates the electrical conductor 262 from the second bulkhead 232. The conduit 265 may be attached to the second bulkhead 232 by swagging to form a metal-to-metal waterproof seal between the conduit 265 and the second bulkhead 232.

Figure 4:
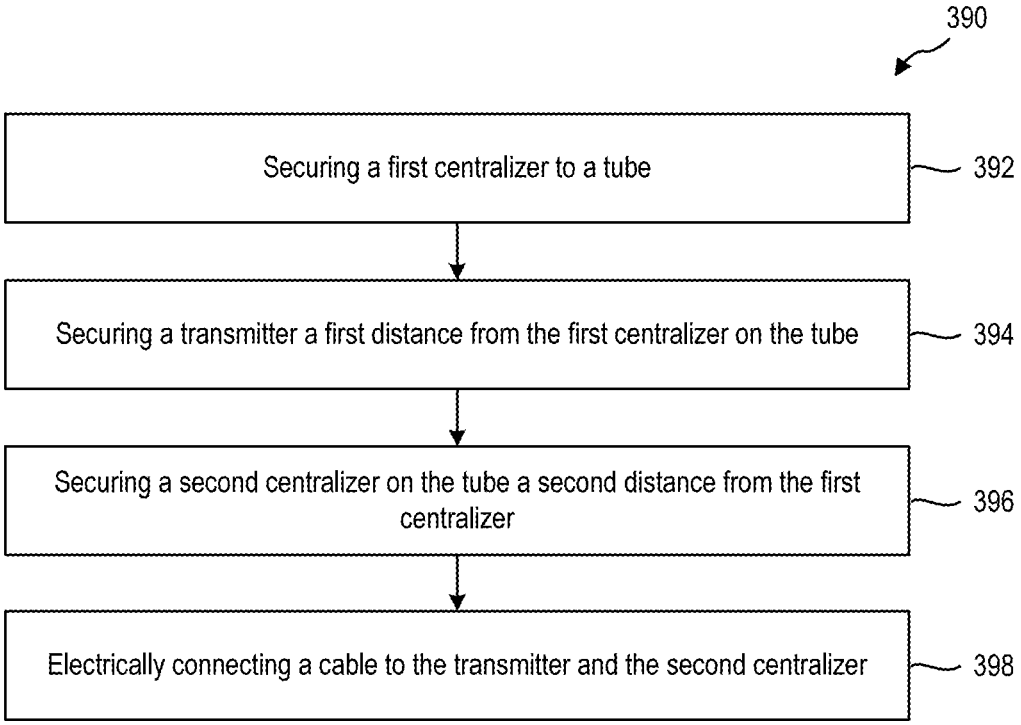
FIG. 4 is a flow chart of a method of assembling a wellbore communication system according to at least one embodiment of the present disclosure.

FIG. 4 is a flow chart of a method 390 of assembling a wellbore communication system. A first conduction component is secured to an electrically conductive axial support body at 392. The first conduction component is electrically conductive and is electrically connected to the electrically conductive axial support body. A transmitter is secured a first distance from the first conduction component on the electrically conductive axial support body at 394. A first electrode of the transmitter is electrically connected to the electrically conductive axial support body, while a second electrode of the transmitter is electrically insulated from the electrically conductive axial support body.

A second conduction component is secured on the electrically conductive axial support body a second distance from the first conduction component at 396. The second distance is greater than the first distance. The second conduction component is electrically conductive and is electrically insulated from the electrically conductive axial support body. A cable is electrically connected to the transmitter and the second conduction component at 398. The cable includes an electrical conductor. The electrical conductor is not in contact with the electrically conductive axial support body.

The cable may be cut to a desired length based on the desired transmission distance in specific wellbore fluid resistivity and geologic formation layer resistivity combinations. A bulkhead may be secured to the electrically conductive axial support body adjacent the transmitter and disposed to support the cable. The cable is electrically insulated from the bulkhead. A conduit may be swaged to the bulkhead. The conduit may be swaged with the second bulkhead, the second conduction component, and the third conduction component around the cable to provide a strong metal-to-metal seal. Alternatively, the conduit may be welded or brazed to the second bulkhead, the second conduction component, and the third conduction component. When the cable is disposed within the conduit, the cable does not contact the conduit. The electrically conductive axial support body may be oriented with the second conduction component below the first conduction component for insertion into a wellbore.

INDUSTRIAL APPLICABILITY

In general, the embodiments of this disclosure are directed to a wellbore communication system. The wellbore communication system may be configured as an asymmetric dipole transceiver. Alternatively, the wellbore communication system may be configured as a symmetric dipole transceiver. In yet others, the wellbore communication system may be configured to transmit only and may omit a receiver.

The wellbore communication system includes an electrically conductive axial support body and a first conduction component secured to the electrically conductive axial support body by a mounting surface of the mounting bracket of the first conduction component. The first conduction component is in electrical contact with the electrically conductive axial support body.

A first bulkhead and a second bulkhead are used to secure an electronics package to the electrically conductive axial support body. The first bulkhead may be secured to the electrically conductive axial support body so that it is in electrical communication with the electrically conductive axial support body and the first conduction component.

The electronics package may include a pressure sensor, a temperature sensor, a flow sensor, a seismic sensor, a resistivity and dielectrics sensor, and other sensors. The electronics package may also include a battery, a processor, a memory, a receiver, and a transmitter. The receiver and transmitter may be combined as a transceiver. The electronics package may be organized in different configurations, such as discrete modules extending parallel to each other along the electrically conductive axial support body, or as annular sections around the electrically conductive axial support body, or as a unitary assembly.

The processor may be a general-purpose single or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor may be referred to as a central processing unit (CPU). The processor may be a single processor or a combination of processors (e.g., an ARM and DSP).

The memory is in electronic communication with the processor. The memory may be any electronic component capable of storing electronic information. For example, the memory may be embodied as random access memory (RAM), read-only memory (ROM), magnetic disk storage media, optical storage media, flash memory devices in RAM, on-board memory included with the processor, erasable programmable read-only memory (EPROM), electrically erasable programmable read-only memory (EEPROM) memory, registers, and so forth, including combinations thereof.

Instructions and data may be stored in the memory. The instructions may be executable by the processor to implement some or all of the functionality disclosed herein. Executing the instructions may involve the use of the data that is stored in the memory. Any of the various examples of modules and components described herein may be implemented, partially or wholly, as instructions stored in memory and executed by the processor. Any of the various examples of data described herein may be among the data that is stored in memory and used during execution of the instructions by the processor.

During operation, the pressure sensor, temperature sensor, flow sensor, seismic sensor, a resistivity and dielectrics sensor, and other sensors may provide data to the processor for processing or storage in the memory. The memory may include instructions that cause the processor to process the data, received signals and transmit the data in a predetermined manner. Further, the first conduction component, electrically conductive axial support body, and first bulkhead may be in electrical communication with the receiver and act as the receiver section of a dipole antenna. In some configurations, the receiver may be in direct electrical communication with the electrically conductive axial support body and not in communication with the first bulkhead. The receiving section has a length that extends from the first conduction component to the receiver.

In some configurations, the receiver may receive a signal that causes the processor to instruct the transmitter to transmit the data saved in memory. Alternatively, the processor may instruct the transmitter to transmit the data stored in the memory according to a predetermined schedule.

The second bulkhead of the wellbore communication system includes electrical insulation that electrically isolates the second bulkhead from the electrically conductive axial support body while allowing the second bulkhead to be secured to the electrically conductive axial support body and support the electronics package. Further, the second bulkhead supports a cable that is in electrical communication with the transmitter.

In this embodiment, the cable includes an electrical conductor covered by electrical insulation. As used in this application, the terms "electrical insulation" or "electrical isolation" include structures that provide electrical shielding and/or electrical insulation. The cable may be flexible and may be wrapped around the electrically conductive axial support body but electrically isolated from the electrically conductive axial support body so that the electrical conductor does not contact the electrically conductive axial support body.

The cable is electrically connected via the second bulkhead to the transmitter. The cable extends from the second bulkhead to a mounting bracket of a second conduction component a distance. In some configurations, the cable may be greater than 2.0 meters. In other configurations, the cable may be greater than 3 meters. In other configurations, the cable may be greater than 5 meters. In yet others, the cable may be greater than 12 meters. In others, the cable may be greater than 25 meters.

The mounting bracket includes a mounting surface that is electrically insulated from the electrically conductive axial support body. The mounting surface has a diameter that allows the mounting bracket to the secured to the electrically conductive axial support body around the electrical insulation. The diameter is greater than diameter. The electrical insulation may be made of polytetrafluoroethylene, glass, and other electrically insulative and shielding materials. The electrical insulation may be made of a fluoropolymer including one or more of a polytetrafluoroethylene, a fluorinated ethylene, a fluorinated propylene, or a perfluoroalkoxy alkane.

The second conduction component is positioned a distance from the first conduction component. The distance is greater than the distance that extends from the first conduction component to the receiver. The transmission section extends from the transmitter through the cable to the second conduction component.

The first conduction component and the second conduction component protect the components of the wellbore communication system from contacting the well casing. Specifically, the first conduction component and the second conduction component keep the wellbore communication system positioned in the middle of the well casing while the first conduction component and the second conduction component are in direct electrical contact with the well casing.

When transmitting, the transmitter passes a voltage and current with one or multiple frequencies through the cable and the second conduction component into the well casing. The well casing includes a shell. The shell may be made of concrete or cement. The current flows toward the first conduction component, the electrically conductive axial support body, and back toward the receiver.

In some configurations, the cable includes an electrical conductor, a gap, and a conduit. The electrical conductor is disposed within, but not in contact with the conduit. The conduit protects the electrical conductor from the environment. The conduit may be made of a stainless steel that has a lower conductivity than the electrical conductor, which may be made of copper. The conduit may be swaged with the second bulkhead to provide a strong metal-to-metal seal. The conduit may be swaged with the second bulkhead, the second conduction component, and the third conduction component around the cable to provide a strong metal-to-metal seal. Alternatively, the conduit may be welded or brazed to the second bulkhead, the second conduction component, and the third conduction component. The gap may be air, electrical insulation, and/or electrical shielding. Instead of a conduit, a shield may also be used to protect the cable from being dislodged or damaged while the wellbore communication system is being placed and operating within a wellbore. The shield may be made of plastic, metal, or a composite. The shield may be secured to the second bulkhead and the second conduction component.

The cable is positioned to extend from the second bulkhead to a mounting bracket of the second conduction component. The cable is electrically connected to the second conduction component. The second conduction component is electrically isolated from the electrically conductive axial support body by an electrically insulative tape made of polytetrafluoroethylene, glass, polycarbonate, or other non-conductive materials. The electrical insulative tape may be made of a fluoropolymer including one or more of a polytetrafluoroethylene, a fluorinated ethylene, a fluorinated propylene, or a perfluoroalkoxy alkane.

In some configurations, a third conduction component may be positioned to support the cable. The third conduction component includes mounting brackets for securing the third conduction component to the electrically conductive axial support body. Optionally, the third conduction component may be electrically isolated from the electrically conductive axial support body by electrical insulation disposed between the third conduction component and the electrically conductive axial support body. In the illustrated configurations, the third conduction component may include electrically insulated through holes that support the electrical conductor. The conduit may be swaged with the third conduction component with additional sections of conduit protecting portions of the electrical conductor as it passes by the conduction component and between the third conduction component and the second conduction component. During use, isolation of the third conduction component minimizes noise from the receiving section from interfering with a transmission section and vice versa. By insulating the receiving section from the transmission section, noise is reduced improving the signal to noise ratio.

In one aspect A1 of the disclosure, a wellbore communication system comprising: a first conduction component configured to be secured to an electrically conductive axial support body and electrically connected to the electrically conductive axial support body, wherein the first conduction component is electrically conductive; a transmitter configured to be positioned a first distance from the first conduction component on the electrically conductive axial support body, wherein a first electrode of the transmitter is configured to be electrically connected to the electrically conductive axial support body; a second conduction component configured to be disposed on the electrically conductive axial support body a second distance from the first conduction component, wherein the second conduction component is electrically conductive, the second distance is greater than the first distance, wherein the second conduction component is configured to be electrically insulated from the electrically conductive axial support body; a cable configured to be electrically connected to a second electrode of the transmitter and the second conduction component, the cable including an electrical conductor, wherein when secured to the electrically conductive axial support body, the electrical conductor is not in contact with the electrically conductive axial support body or with fluid that may be surrounding the wellbore communication system.

A2. The wellbore communication system of aspects A1, further comprising a bulkhead configured to be secured to the electrically conductive axial support body, wherein the bulkhead is configured to be electrically isolated from the cable.

A3. The wellbore communication system of aspects A2, wherein the cable extends through the bulkhead to the transmitter.

A4. The wellbore communication system of aspects A1, A2, or A3, further comprising a conduit configured to connect to the bulkhead around the cable, wherein when the cable is disposed within the conduit, the cable does not contact the conduit.

A5. The wellbore communication system of aspects A1, A2, A3, or A4, wherein the conduit is made of stainless steel that has a greater electrical resistance than copper.

A6. The wellbore communication system of aspects A1, A2, A3, A4, or A5, wherein the electrical conductor is electrically insulated.

A7. The wellbore communication system of aspects A1, A2, A3, A4, A5, or A6, wherein the bulkhead includes a glass sealed insulator disposed between the bulkhead and the cable.

A8. The wellbore communication system of aspects A1, A2, A3, A4, A5, A6, or A7, further comprising an electrically insulating tape configured to be disposed between the electrically conductive axial support body and the second conduction component.

A9. The wellbore communication system of aspects A8, wherein the electrically insulating tape includes a polytetrafluoroethylene.

A10. The wellbore communication system of aspects A8 or A9, wherein the electrically insulating tape includes glass.

All. The wellbore communication system of aspects A1, A2, A3, A4, A5, A6, A7, A8, A9, or A10, wherein the cable has a length ranging between about 0.5 meter and about 25 meters.

A11A. The wellbore communication system of aspects A1, A2, A3, A4, A5, A6, A7, A8, A9, or A10, wherein the cable is at least 3 meters long.

A12. The wellbore communication system of aspects A1, A2, A3, A4, A5, A6, A7, A8, A9, or A10, wherein the cable is at least 5 meters long.

A13. The wellbore communication system of aspects A1, A2, A3, A4, A5, A6, A7, A8, A9, or A10, wherein the cable is at least 10 meters long.

A14. The wellbore communication system of aspects A1, A2, A3, A4, A5, A6, A7, A8, A9, A10, A11, A12, or A13, further comprising a receiver secured to the electrically conductive axial support body and in communication with the transmitter.

A15. The wellbore communication system of aspect A14, further comprising a memory and a processor in communication with the receiver and transmitter.

A16. The wellbore communication system of aspect A15, wherein when the receiver receives a signal, the transmitter amplifies and retransmits the signal.

A17. The wellbore communication system of aspects A1, A2, A3, A4, A5, A6, A7, A8, A9, A10, A11, A12, A13, A14, A15, or A16, further comprising a pressure sensor in electrical communication with the transmitter, wherein the processor saves a data collected from the pressure sensor and saves the data in the memory.

A18. The wellbore communication system of aspects A1, A2, A3, A4, A5, A6, A7, A8, A9, A10, A11, A12, A13, A14, A15, A16, or A17, wherein the memory contains instructions that cause the processor to cause the transmitter to transmit the data.

A19. The wellbore communication system of aspects A1, A2, A3, A4, A5, A6, A7, A8, A9, A10, A11, A12, A13, A14, A15, A16, A17, or A18, wherein the receiver and transmitter are part of a unitary transceiver.

A20. The wellbore communication system of aspects A1, A2, A3, A4, A5, A6, A7, A8, A9, A10, A11, A12, A13, A14, A15, A16, A17, A18, or A19, further comprising a battery in electrical communication with the transmitter.

A21. The wellbore communication system of aspects A1, A2, A3, A4, A5, A6, A7, A8, A9, A10, A11, A12, A13, A14, A15, A16, A17, A18, A19, or A20, wherein when installed in a wellbore, the first conduction component is disposed above the second conduction component.

A22. The wellbore communication system of aspects A1, A2, A3, A4, A5, A6, A7, A8, A9, A10, A11, A12, A13, A14, A15, A16, A17, A18, A19, A20, or A21, wherein the transmitter is configured to inject a voltage through the cable into the second conduction component.

A23. The wellbore communication system of aspects A1, A2, A3, A4, A5, A6, A7, A8, A9, A10, A11, A12, A13, A14, A15, A16, A17, A18, A19, A20, A21, or A22, further comprising a third conduction component configured to be secured to the electrically conductive axial support body, wherein the third conduction component includes a through hole sized to receive and support the cable, wherein the through hole is electrically insulated.

A24. The wellbore communication system of aspects A23, wherein the third conduction component is configured to be electrically insulated from the electrically conductive axial support body.

A25. The wellbore communication system of aspects A1, A2, A3, A4, A5, A6, A7, A8, A9, A10, A11, A12, A13, A14, A15, A16, A17, A18, A19, A20, A21, A22, A23, A24, wherein the cable is flexible.

A26. The wellbore communication system of aspects A1, A2, A3, A4, A5, A6, A7, A8, A9, A10, A11, A12, A13, A14, A15, A16, A17, A18, A19, A20, A21, A22, A23, A24, or A25, further comprising a temperature sensor in electrical communication with the transmitter, wherein the processor saves a data collected from the temperature sensor and saves the data in the memory.

In another aspect B1 of the disclosure, a wellbore communication system comprising: an electrically conductive axial support body; a first conduction component secured to the electrically conductive axial support body and electrically connected to the electrically conductive axial support body, wherein the first conduction component is electrically conductive; a transmitter positioned a first distance from the first conduction component on the electrically conductive axial support body, wherein a first electrode of the transmitter is electrically connected to the electrically conductive axial support body; a second conduction component disposed on the electrically conductive axial support body a second distance from the first conduction component, the second distance being greater than the first distance, wherein the second conduction component is electrically conductive and is electrically insulated from the electrically conductive axial support body; a cable electrically connected to a second electrode of the transmitter and the second conduction component, the cable including an electrical conductor, wherein the electrical conductor is not in contact with the electrically conductive axial support body or with fluid that may be surrounding the wellbore communication system.

B2. The wellbore communication system of aspects B1, wherein the electrical conductor is electrically insulated.

B3. The wellbore communication system of aspects B1 or B2, further comprising a bulkhead secured to the electrically conductive axial support body adjacent the transmitter, wherein the cable is electrically isolated from the bulkhead and extends through the bulkhead from the transmitter.

B4. The wellbore communication system of aspects B1, B2, or B3, further comprising a conduit connected to the bulkhead around the cable, wherein when the cable is disposed within the conduit, the cable does not contact the conduit.

B5. The wellbore communication system of aspects B1, B2, B3, or B4, wherein the conduit is made of stainless steel that has a greater electrical resistance than copper.

B6. The wellbore communication system of aspects B1, B2, B3, B4, or B5, wherein the cable is electrically insulated.

B7. The wellbore communication system of aspects B1, B2, B3, B4, B5, or B6, wherein the bulkhead includes a glass sealed insulator disposed between the bulkhead and the cable.

B8. The wellbore communication system of aspects B1, B2, B3, B4, B5, B6, or B7, further comprising an electrically insulating tape disposed between the electrically conductive axial support body and the second conduction component.

B9. The wellbore communication system of aspect B8, wherein the electrically insulating tape includes a fluoropolymer including one or more of a polytetrafluoroethylene, a fluorinated ethylene, a fluorinated propylene, or a perfluoroalkoxy alkane.

B10. The wellbore communication system of aspects B8 or B9, wherein the electrically insulating tape includes glass.

B11. The wellbore communication system of aspects B1, B2, B3, B4, B5, B6, B7, B8, B9, or B10, wherein the cable has a length ranging between about 0.5 meter and about 25 meters.

B11A. The wellbore communication system of aspects B1, B2, B3, B4, B5, B6, B7, B8, B9, or B10, wherein the cable is at least 3 meters long.

B12. The wellbore communication system of aspects B1, B2, B3, B4, B5, B6, B7, B8, B9, or B10, wherein the cable is at least 5 meters long.

B13. The wellbore communication system of aspects B1, B2, B3, B4, B5, B6, B7, B8, B9, or B10, wherein the cable is at least 10 meters long.

B14. The wellbore communication system of aspects B1, B2, B3, B4, B5, B6, B7, B8, B9, B10, B11, B12, or B 13, further comprising a receiver secured to the electrically conductive axial support body and in communication with the transmitter.

B15. The wellbore communication system of aspect B14, further comprising a memory and a processor in communication with the receiver and transmitter.

B16. The wellbore communication system of aspect B15, wherein when the receiver receives a signal, the transmitter amplifies and retransmits the signal.

B17. The wellbore communication system of aspects B1, B2, B3, B4, B5, B6, B7, B8, B9, B10, B11, B12, B13, B14, B15, or B16, further comprising a pressure sensor in electrical communication with the transmitter, wherein the processor saves a data collected from the pressure sensor and saves the data in the memory.

B18. The wellbore communication system of aspects B1, B2, B3, B4, B5, B6, B7, B8, B9, B10, B11, B12, B13, B14, B15, B16, or B17, wherein the memory contains instructions that cause the processor to cause the transmitter to transmit the data.

B19. The wellbore communication system of aspects B1, B2, B3, B4, B5, B6, B7, B8, B9, B10, B11, B12, B13, B14, B15, B16, B17, or B18, wherein the receiver and transmitter are part of a unitary transceiver.

B20. The wellbore communication system of aspects B1, B2, B3, B4, B5, B6, B7, B8, B9, B10, B11, B12, B13, B14, B15, B16, B17, B18, or B19, further comprising a battery in electrical communication with the transmitter.

B21. The wellbore communication system of aspects B1, B2, B3, B4, B5, B6, B7, B8, B9, B10, B11, B12, B13, B14, B15, B16, B17, B18, B19, or B20, wherein when installed in a wellbore, the first conduction component is disposed above the second conduction component.

B22. The wellbore communication system of aspects B1, B2, B3, B4, B5, B6, B7, B8, B9, B10, B11, B12, B13, B14, B15, B16, B17, B18, B19, B20, or B21, wherein when transmitting, the transmitter injects a current through the cable into the second conduction component.

B23. The wellbore communication system of aspects B1, B2, B3, B4, B5, B6, B7, B8, B9, B10, B11, B12, B13, B14, B15, B16, B17, B18, B19, B20, B21, or B22, further comprising a third conduction component secured to the electrically conductive axial support body, wherein the third conduction component includes a through hole sized to receive and support the cable, wherein the through hole is electrically insulated.

B24. The wellbore communication system of aspects B23, wherein the third conduction component is electrically insulated from the electrically conductive axial support body.

B25. The wellbore communication system of aspects B1, B2, B3, B4, B5, B6, B7, B8, B9, B10, B11, B12, B13, B14, B15, B16, B17, B18, B19, B20, B21, B22, B23, or B24, wherein the cable is flexible.

B26. The wellbore communication system of aspects B1, B2, B3, B4, B5, B6, B7, B8, B9, B10, B11, B12, B13, B14, B15, B16, B17, B18, B19, B20, B21, B22, B23, B24, or B25, further comprising a temperature sensor in electrical communication with the transmitter, wherein the processor saves a data collected from the temperature sensor and saves the data in the memory.

In yet another aspect C1 of the disclosure, a method comprising: securing a first conduction component to an electrically conductive axial support body, wherein the first conduction component is electrically conductive and is electrically connected to the electrically conductive axial support body; securing a first electrode of the transmitter positioned a first distance from the first conduction component on the electrically conductive axial support body, wherein the first electrode of the transmitter is electrically connected to the electrically conductive axial support body; securing a second conduction component on the electrically conductive axial support body a second distance from the first conduction component, the second distance being greater than the first distance, wherein the second conduction component is electrically conductive and is electrically insulated from the electrically conductive axial support body; and electrically connecting a cable to a second electrode of the transmitter and the second conduction component, the cable including an electrical conductor, wherein the electrical conductor is not in contact with the electrically conductive axial support body or with fluid that may be surrounding the wellbore communication system.

C2. The method of aspect C1, further comprising cutting the cable to a desired length based on a desired transmission frequency.

C3. The method of aspects C1 or C2, further comprising securing a bulkhead to the electrically conductive axial support body adjacent the transmitter and disposed to support the cable, wherein the cable is electrically isolated from the bulkhead, the method further comprising swaging a conduit to the bulkhead around the cable, wherein when the cable is disposed within the conduit, the cable does not contact the conduit.

C4. The method of aspects C1, C2, or C3, further comprising orienting the electrically conductive axial support body with the second conduction component below the first conduction component for insertion into a wellbore.

C5. The method of aspects C1, C2, C3, or C4, wherein the electrical conductor is electrically insulated.

C6. The method of aspects C1, C2, C3, C4, or C5, further comprising connecting a battery to the transmitter.

The embodiments of a wellbore communication system and method have been primarily described with reference to wellbore operations. The wellbore communication system described herein may be used in applications other than the operation of a wellbore, including drilling of a wellbore and monitoring closed or abandoned wellbores. In other embodiments, a wellbore communication system according to the present disclosure may be used outside a wellbore or other downhole environment used for the exploration or production of natural resources. For instance, a wellbore communication system of the present disclosure may be used in a borehole used for placement of utility lines or underground communications. Accordingly, the terms "wellbore," "borehole" and the like should not be interpreted to limit tools, systems, assemblies, or methods of the present disclosure to any particular industry, field, or environment.

As used herein, the term "formation" refers to any finite subsurface region. As used herein, the term "wellbore" refers to a hole in the subsurface made by drilling or insertion of a conduit into the subsurface. A wellbore may have a substantially circular cross section, or other cross-sectional shapes (e.g., circles, ovals, squares, rectangles, triangles, slits, or other regular or irregular shapes). As used herein, the term "well," when referring to an opening in the formation, may be used interchangeably with the term "wellbore".

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A wellbore communication system comprising:

a first conduction component configured to be secured to an electrically conductive axial support body and electrically connected to the electrically conductive axial support body, wherein the first conduction component is electrically conductive;

a transmitter having a first electrode and a second electrode, wherein the transmitter is configured to be positioned a first distance from the first conduction component on the electrically conductive axial support body, wherein the first electrode of the transmitter is configured to be electrically connected to the electrically conductive axial support body;

a second conduction component configured to be disposed on the electrically conductive axial support body a second distance from the first conduction component, wherein the second conduction component is electrically conductive, the second distance is greater than the first distance, wherein the second conduction component is configured to be electrically insulated from the electrically conductive axial support body; and a cable configured to extend along the electrically conductive axial support body and be electrically connected to the second electrode of the transmitter and the second conduction component, the cable including an electrical conductor, wherein when secured to the electrically conductive axial support body, the electrical conductor is not in contact with the electrically conductive axial support body.

2. The wellbore communication system of claim 1, further comprising a bulkhead configured to be secured to the electrically conductive axial support body and electrically insulated from the electrically conductive axial support body, the wellbore communication system further comprising a conduit configured to connect around the cable.

3. The wellbore communication system of claim 2, wherein an electrically insulative gap is provided between the conduit and the electrical conductor.

4. The wellbore communication system of claim 2, wherein a gap is provided between the conduit and the electrical conductor is partially conductive and made out of metal.

5. The wellbore communication system of claim 4, wherein a metal-to-metal seal is used to construct this gap.

6. The wellbore communication system of claim 1, wherein the cable has a length ranging between about 0.5 meters and about 25 meters.

7. The wellbore communication system of claim 1, further comprising a memory, a processor in communication with the memory and the transmitter, and a pressure sensor in electrical communication with the processor and the transmitter, wherein the processor saves a data collected from the pressure sensor in the memory, the memory containing instructions that cause the processor to cause the transmitter to transmit the data.

8. The wellbore communication system of claim 1, further comprising a third conduction component configured to be secured to the electrically conductive axial support body, wherein the third conduction component is insulated from and supports the cable.

9. A wellbore communication system comprising:

an electrically conductive axial support body;

a first conduction component secured to the electrically conductive axial support body and electrically connected to the electrically conductive axial support body, wherein the first conduction component is electrically conductive;

a transmitter positioned a first distance from the first conduction component on the electrically conductive axial support body, wherein a first electrode of the transmitter is electrically connected to the electrically conductive axial support body;

a second conduction component disposed on the electrically conductive axial support body a second distance from the first conduction component, the second distance being greater than the first distance, wherein the second conduction component is electrically conductive and is electrically insulated from the electrically conductive axial support body; and a cable electrically connected to a second electrode of the transmitter and the second conduction component, the cable including an electrical conductor, wherein the electrical conductor is not in contact with the electrically conductive axial support body.

10. The wellbore communication system of claim 9, further comprising a bulkhead secured to the electrically conductive axial support body adjacent the transmitter and disposed to conduct electric current from the transmitter to the cable while being electrically insulated from the electrically conductive axial support body and an outside surface of the bulkhead, the wellbore communication system further comprising a conduit connected to the bulkhead around the cable, wherein when the cable is disposed within the conduit, the cable does not contact the conduit.

11. The wellbore communication system of claim 9, wherein the cable has a length ranging between about 0.5 meters and about 25 meters.

12. The wellbore communication system of claim 9, further comprising an electrically insulating tape disposed between the electrically conductive axial support body and the second conduction component to electrically insulate the second conduction component from the electrically conductive axial support body.

13. The wellbore communication system of claim 12, wherein the electrically insulating tape includes a fluoropolymer including one or more of a polytetrafluoroethylene, a fluorinated ethylene, a fluorinated propylene, or a perfluoroalkoxy alkane.

14. The wellbore communication system of claim 9, further comprising a memory, a processor in communication with the memory and the transmitter, and a pressure sensor in electrical communication with the processor and the transmitter, wherein the processor saves a data collected from the pressure sensor in the memory, the memory containing instructions that cause the processor to cause the transmitter to transmit the data.

15. The wellbore communication system of claim 9, further comprising a third conduction component configured to be secured to the electrically conductive axial support body and disposed between the first conduction component and the second conduction component, wherein the third conduction component includes a through hole supporting the cable, wherein the cable is electrically insulated from the third conduction component.

16. The wellbore communication system of claim 9, wherein when installed in a wellbore, the first conduction component is disposed above the second conduction component.

17. The wellbore communication system of claim 9, wherein when transmitting, the transmitter injects a current through the cable into the second conduction component.

18. A method comprising:

securing a first conduction component to an electrically conductive axial support body, wherein the first conduction component is electrically conductive and is electrically connected to the electrically conductive axial support body;

securing a transmitter positioned a first distance from the first conduction component on the electrically conductive axial support body, wherein a first electrode of the transmitter is electrically connected to the electrically conductive axial support body;

securing a second conduction component on the electrically conductive axial support body a second distance from the first conduction component, the second distance being greater than the first distance, wherein the second conduction component is electrically conductive and is electrically insulated from the electrically conductive axial support body; and electrically connecting a cable to a second electrode of the transmitter and the second conduction component, the cable including an electrical conductor, wherein the electrical conductor is not in contact with the electrically conductive axial support body.

19. The method of claim 18, further comprising cutting the cable to a desired length based on a desired communication length.

20. The method of claim 18, further comprising orienting the electrically conductive axial support body with the second conduction component below the first conduction component for insertion into a wellbore.

* * * * *